US008310334B2

(12) United States Patent
Chen et al.

(10) Patent No.: US 8,310,334 B2
(45) Date of Patent: Nov. 13, 2012

(54) SURFACE MOUNT RESISTOR

(75) Inventors: Ching-Feng Chen, Hsin-chu (TW); Kun-Hong Shih, Hsin-chu (TW); Yen-Ting Lin, Hsin-chu (TW); Yin-Tien Yeh, Hsin-chu (TW)

(73) Assignee: Cyntec, Co., Ltd., Hsin-Chu (TW)

( * ) Notice: Subject to any disclaimer, the term of this patent is extended or adjusted under 35 U.S.C. 154(b) by 210 days.

(21) Appl. No.: 12/773,152

(22) Filed: May 4, 2010

(65) Prior Publication Data

US 2011/0057766 A1 Mar. 10, 2011

(30) Foreign Application Priority Data

Sep. 8, 2009 (TW) ..... 98130234 A

(51) Int. Cl.
*H01C 1/034* (2006.01)

(52) U.S. Cl. ..... 338/262; 338/226; 338/307; 338/327; 338/332

(58) Field of Classification Search ..... 338/262, 338/226, 248, 266, 307, 308, 327, 332
See application file for complete search history.

(56) References Cited

U.S. PATENT DOCUMENTS

| | | | | |
|---|---|---|---|---|
| 3,996,551 | A * | 12/1976 | Croson | 338/309 |
| 4,467,312 | A * | 8/1984 | Komatsu | 338/309 |
| 5,111,179 | A * | 5/1992 | Flassayer et al. | 338/313 |
| 6,229,098 | B1 * | 5/2001 | Dunn et al. | 174/260 |
| 6,727,798 | B2 * | 4/2004 | Akhtman et al. | 338/309 |
| 2004/0262712 | A1 * | 12/2004 | Doi | 257/536 |

FOREIGN PATENT DOCUMENTS

| | | | |
|---|---|---|---|
| CN | 101243524 | A | 8/2008 |
| CN | 101465184 | A | 6/2009 |
| JP | 2003282305 | A | 10/2003 |
| TW | 200830334 | | 7/2008 |
| TW | 200830333 | | 9/2008 |

OTHER PUBLICATIONS

China Official Action issued on Dec. 27, 2011.

* cited by examiner

*Primary Examiner* — Kyung Lee
(74) *Attorney, Agent, or Firm* — Chun-Ming Shih; HDLS IPR Services

(57) ABSTRACT

A surface mount resistor includes a resistance body, a first protective layer, a heat-transfer layer, a second protective layer and two electrode layers. The resistance body has a first end portion, a second end portion and a central portion between the first end portion and the second end portion. The first protective layer is disposed on the central portion of the resistance body, and the first end portion and the second end portion are exposed. The heat-transfer layer is plated on at least part of the resistance body. The second protective layer is disposed on at least part of the heat-transfer layer. The electrode layers are respectively arranged on the first end portion and the second end portion, and electrically connected with the heat-transfer layer.

19 Claims, 5 Drawing Sheets

SURFACE MOUNT RESISTOR

BACKGROUND OF THE INVENTION

1. Field of the Invention

The present invention relates to an electronic component, and more particularly, to a surface mount resistor for current sensing.

2. Description of Prior Art

Following continuous progress of electronic circuit technology, stability requirement of resistance value of resistor has been increased day by day. Some performances of traditional chip resistor, such as temperature coefficient of resistance (TCR), have gradually been unable to satisfy the requirement of high stability, thus, causing its limitation in terms of application.

In order to promote thermal stability of resistor, Taiwan Patent Publication No. 200830333 and 200830334 have proposed a current sensing resistor, in which a heat-dissipation body with high performance is formed on a surface of a resistor body to dissipate the heat generated therefrom, such that the object of promoting the operational power of the current sensing resistor is achieved.

The resistor body and the heat-dissipation body with high performance are respectively formed by a stamping process and then combined by a pressing process or an adhering process. However, during the stamping process, surfaces of the resistor body and the heat-dissipation body will generate deckle edges or protrusions, which probably penetrate the pressed or adhesive layer (its thickness is about 30 μm) during the combination of the resistor body and the heat-dissipation body, causing a short circuit, because of the contact between the resistor body and the heat-dissipation body, so the resistance value of the resistor can't fulfill preset requirement. Furthermore, since the current sensing resistor adopts two rectangular heat-dissipation bodies, which are symmetrical to two sides of the resistor body, only heat at two sides of the resistor body can be carried away, while the heat at the central portion with higher temperature can't be dissipated. This kind of design has imposed a great limitation on carrying away the heat generated in resistor body, which limits the promotion of the operational power thereof.

SUMMARY OF THE INVENTION

Therefore, in order to solve aforementioned problems, the present invention is to provide a surface mount resistor which has a better heat dissipation effect and a better thermal stability of the resistance value.

The present invention is to provide a surface mount resistor including a resistance body, a first protective layer, a first heat-transfer layer and two electrode layers. The resistance body has a first end portion, a second end portion opposite to the first end portion and a central portion between the first end portion and the second end portion. The resistance body defines a central line. The first protective layer is disposed on at least part of the central portion of the resistance body to expose the first end portion and the second end portion. The first heat-transfer layer is extended from the first end portion, through the central portion and toward the first protection layer, and has a first heat-transfer portion and a second heat-transfer portion connected to the first heat-transfer portion. The first protective layer is arranged between the first heat-transfer portion and the resistance body as an electric insulation layer. The second heat-transfer portion is electrically connected to the first end portion of the resistance body. The electrode layers respectively envelop the first end portion and the second end portion of the resistance body, and electrically connect to the second heat-transfer layer.

BRIEF DESCRIPTION OF DRAWING

The features of the present invention believed to be novel are set forth with particularity in the appended claims. The present invention itself, however, may be best understood by reference to the following detailed description, which describes a number of embodiments of the present invention, taken in conjunction with the accompanying drawings, in which:

DETAILED DESCRIPTION OF THE INVENTION

In cooperation with attached drawings, the technical contents and detailed description of the present invention are described thereinafter according to a number of embodiments, not used to limit its executing scope. Any equivalent variation and modification made according to appended claims is all covered by the claims claimed by the present invention.

Figure 1:
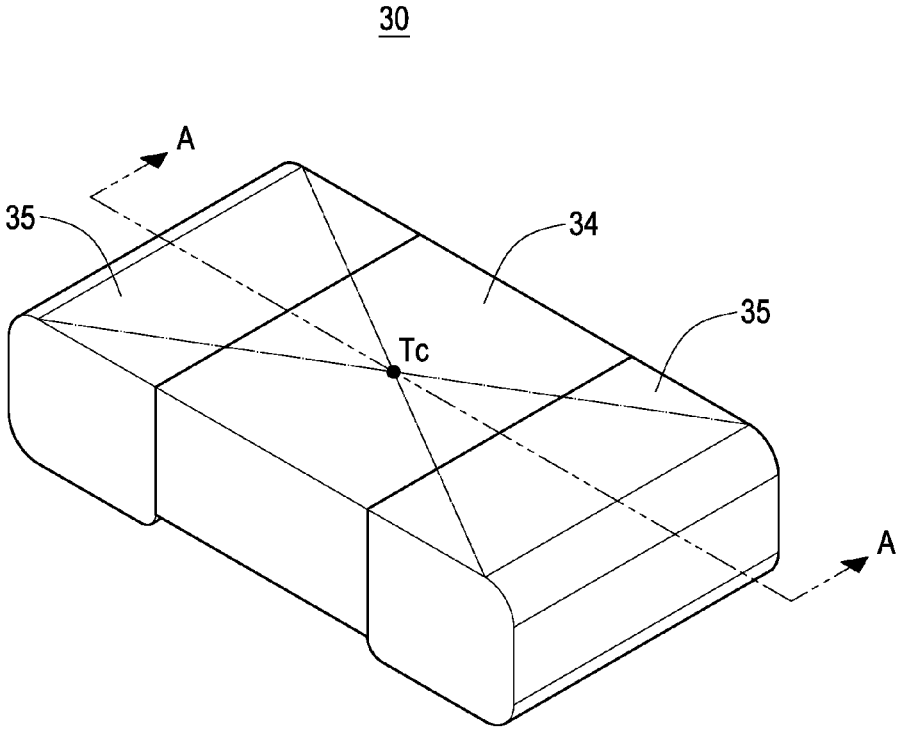
FIG. 1 is an illustration of a surface mount resistor according to an embodiment of the present invention.
Figure 2:
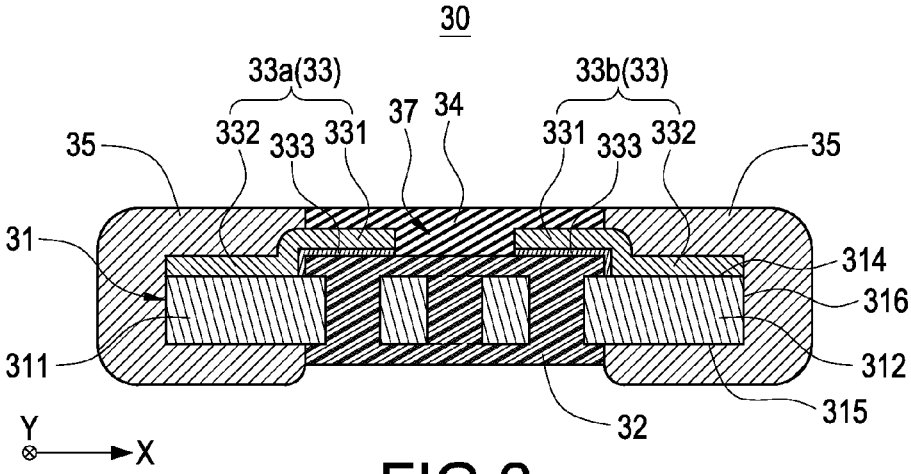
FIG. 2 is a cross-sectional view along a sectional line "A-A" in FIG. 1.

As shown in FIG. 1 and FIG. 2, a surface mount resistor 30 according to the first embodiment of the invention is shown. The surface mount resistor 30, for example a current sensing resistor have a low resistance value, includes a resistance body 31, a first protective layer 32, at least one heat-transfer layer 33, a second protective layer 34 and two electrode layers 35.

Figure 3:
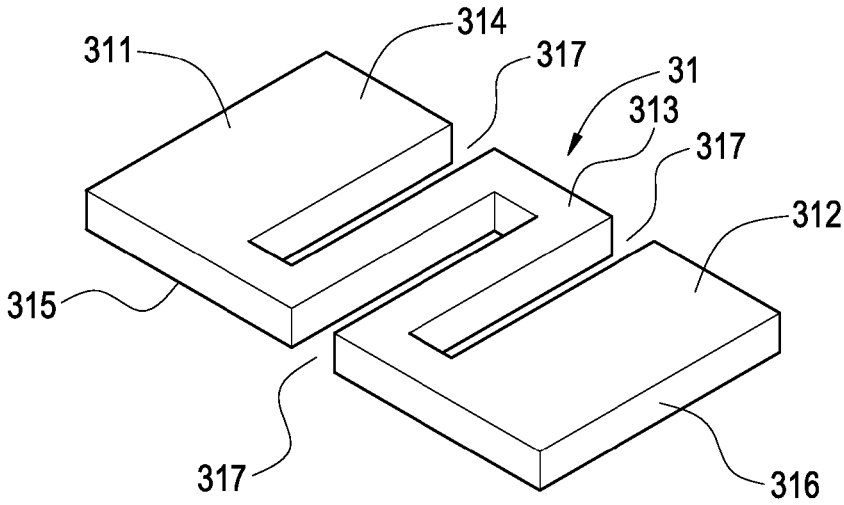
FIG. 3 is an illustration of a resistance body of a surface mount resistor according to an embodiment of the present invention.

As shown in FIG. 3, the resistance body 31 has a first end portion 311, a second end portion 312 opposite to the first end portion 311 and a central portion 313 arranged between the first end portion 311 and the second end portion 312. The resistance body 31 also has a first surface 314, a second surface 315 and a plurality of lateral faces 316 connected to the first surface 314 and the second surface 315. The resistance body is generally formed from a metallic piece having a low temperature coefficient of resistance (TCR), such as manganese-copper alloy, nickel-chromium alloy, nickel-iron alloy, or a copper based alloy. In this embodiment, the central portion 313 of the resistance body 31 has a plurality of through holes 317 penetrating the first surface 314 and the second surface 315, making the central portion 313 formed as a configuration curved and folded back and forth many times, however, this embodiment is not limitation for the scope of the present invention. The through holes 317 can be formed by a stamping process, a punching process, an etching process, a milling process, and the likes.

Figure 4:
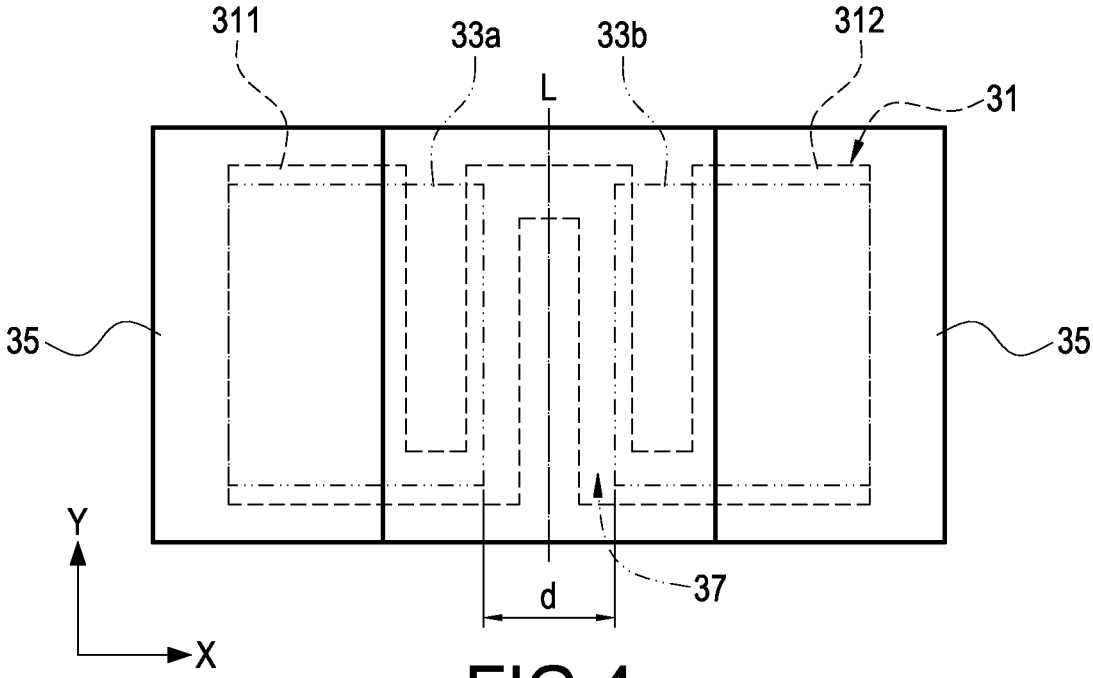
FIG. 4 is a top view of a surface mount resistor according to an embodiment of the present invention.

As shown in FIG. 4, in this embodiment, on the first surface 314 of the resistance body 31, a first direction X (for example, a length direction of the resistance body 31), a second direction Y (for example, a width direction of the resistance body 31) vertical to the first direction X and a central line L parallel to the second direction Y and passing through the geometric center of the first surface 314 are defined.

Now referring to FIG. 2 and FIG. 3, the first protective layer 32 is disposed on at least part of the central portion 313 to expose the first end portion 311 and the second end portion 312. In this embodiment, the first protective layer 32 surrounds the central portion 313 of the resistance body 31, which is on the first surfaces 314, the second surfaces 315 and the lateral faces 316 of the central portion 313 of the resistor body 31 and is filled into the through holes 317. The first protective layer 32 is made of an insulating material and manufactured by a dry film process. The insulating material includes polyester, photo-resist dry film and polyethylene. The thickness of the first protective layer 32 is about 50 to 150 μm, and the first protective layer 32 is a solid body with a heat transfer coefficient of about 0.2 to 0.5 W/(m K).

The heat-transfer layer 33 is disposed on at least part of the resistance body 31 and at least part of the first protective layer 32. As shown in FIG. 2 and FIG. 4, there are two heat-transfer layers 33 in this embodiment, which are disposed symmetrically on the first surface 314 of the resistance boy 31. The heat-transfer layer 33 includes a first heat-transfer layer 33*a* extended from the first end portion 33, through the central portion 313 and toward the first protective layer 32, and a second heat-transfer layer 33*b* extended from the second portion 312, through the central portion 313 and toward the first protective layer 32. The first protective layer 32 is used as an electric insulation layer arranged among the heat-transfer layers 33*a*, 33*b* and the central portion 313 of the resistance body 31. A gap 37 with preset width d is formed between the first heat-transfer layer 33*a* and the second heat-transfer layer 33*b*. The projection of the first heat-transfer layer 33*a* and the second heat-transfer layer 33*b* on the first surface 314 of the resistance body 31 is a rectangle respectively in this embodiment, but are not limited to, in other embodiments, the first heat-transfer layer and the second heat-transfer layer may be a triangle, a stripe or otherwise (discussed below).

As shown in FIG. 2, each heat-transfer layers 33 (for example, the first heat-transfer layer 33*a* or the second heat-transfer layer 33*b*) includes a first heat-transfer portion 331 and a second heat-transfer portion 332 connected to the first heat-transfer portion 331. The first heat-transfer portion 331 covers at least part of the central portion 313 of the resistance body 31 and at least part of the first protective layer 32, while the second heat-transfer portion 332 directly covers the first end portion 311 or the second end portion 312 to form an electric connection thereto, thereby, making the second heat-transfer portion 332 as an internal electrode of the resistance body 31. In this embodiment, the width of the first heat-transfer portion 331 is substantially equal to that of the second heat-transfer portion 332. In the meantime, the width direction of the first heat transfer portion 331 (namely, the second direction Y) is parallel to the length direction of the gap 37, and the length direction of the first heat-transfer portion 331 (namely, the first direction X) is parallel to the width direction of the gap 37.

The first heat-transfer portion 331 and the second heat-transfer portion 332 are integrally formed into an outer metallic layer, and each heat-transfer layer 33 further includes an inner metallic layer 333. The thickness of the inner metallic layer 333 is about 2 to 3 μm, which is smaller than the thickness of the outer metallic layer. The inner metallic layer 333 is disposed on the first protective layer 32 and located between the first heat-transfer portion 331 and the first protective layer 32. The heat-transfer layer 33 is formed by a deposition process. In this embodiment, the inner metallic layer 333 is formed by a sputtering process, such as, a vapor-phase deposition method, while the outer metallic layer is formed by a plating method. More specifically, the inner metallic layer 333 may be made of, for example, Mn, Ni—Cu alloy and Ni—Cr alloy. The outer metallic layer can be made of a material of copper, arum, silver, and aluminum, having a high heat transfer coefficient. One thing worthy of mentioning is that, when the adherence between the outer metallic layer and the first protective layer 32 is poor, the arrangement of the inner metallic layer 333 can enhance its adherence, however, the arrangement of the inner metallic layer being able to be skipped, vice versa.

As shown in FIG. 2, the second protective layer 34 disposed on at least part of the heat-transfer layer 33 covers the central portion 313 of the resistance body 31 to expose the first end portion 311 and the second end portion 312, and is filled into the gap 37. In this embodiment, the second protective layer 34 is disposed on the first heat-transfer portion 331 of the heat-transfer layer 33 and can be manufactured by a printing process. The second protective layer 34 is made of an insulating material, such as an epoxy resin. Preferably, the second protective layer 34 can be made of phenolic resin (also called bakelite, or electric wood), which can provide a better thermal resistance, electric performance (for example, withstand voltage characteristic) and mechanical performance (for example, tensile strength and bending strength), in comparison with epoxy resin. In addition, the second protective layer 34 can be made of an insulating material composed of far infrared powder and resin body. The composition of the far infrared powder includes at least one of Mg, Al, Fe and B. The far infrared powder can be adapted for absorbing heat generated from the surface mount resistor and converting the absorbed heat into radiation energy, which can be dissipated away, thereby, further lowering down the temperature of the surface mount resistor. One thing worthy of mentioning is that the composition of the far infrared powder in the insulating material is over 90%, so the second protective layer 34 can be formed by a molding process.

Two electrode layers 35 respectively cover the first end portion 311 and the second end portion 312 of the resistance body 31. The second protective layer 34 is arranged between two electrode layers 35 and lower than two electrode layers 35. In the meantime, two electrode layers 35 are electrically connected to the second heat-transfer portion 332 of the heat-transfer layer 33 respectively. The parts of the resistance body 31, which are covered by the electrode layers 35, are defined as a first end portion 311 and a second end portion 312. The electrode layer 35 is formed by a barrel plating process. In this embodiment, the electrode layers 35 cover at least parts of the first surfaces 314, the second surfaces 315 and the lateral faces 316 located at the first end portion 311 and the second end portion 312 and also cover the second heat-transfer portion 332.

According to the present invention, the first protective layer 32 is first adapted for enveloping the resistance body 31 having burrs and protrusions. Then, the heat-transfer layer 33 is formed on the first protective layer 32 by a deposition process. Thereby, it can ensure that the burrs and protrusions of the resistance body 31 won't penetrate the first protective layer 32 during the combination process of the resistance body 31 and the heat-transfer layer 33. In the meantime, the heat-transfer layer 33 also won't cause any damage to the first protective layer 32. Therefore, it can effectively avoid a short circuit due to the contact of the heat-transfer layer 33 and the resistance body 31. In addition, the thickness of the first protective layer 32 adopted by the present invention is thicker than that of adhesive layer of prior arts. Thereby, it can avoid the burrs or protrusions of the surfaces of the resistance body 31 from penetrating the first protective layer 32, because the interval between the heat-transfer layer 33 and the resistance body 31 is larger than the burrs and protrusions.

Furthermore, the first heat-transfer layer 33*a* and the second heat-transfer layer 33*b* are embedded in the surface mount resistor 30 and cover at least part of the central portion 313. Parts of the heat-transfer layer 33 are in direct electrical connection with the resistor body 31 to function as internal electrodes. Therefore, the transfer area is increased and the transfer path is shortened. It can effectively transfer the heat generated from the resistor body 31 to the electrode layers 35 at two sides of the surface mount resistor 30 respectively, whereby the heat is conducted to the circuit board via the bond pad arranged thereon. Thus, the temperature of the surface mount resistor 30 is reduced, the thermal stability of the surface mount resistor 30 is promoted and a more accurate measurement can be resulted.

Figure 5:
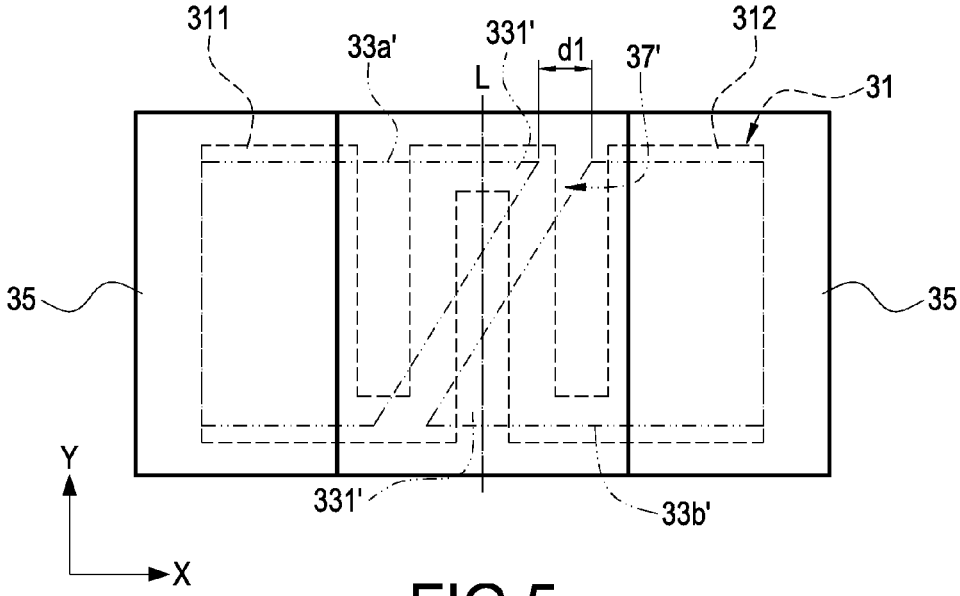
FIG. 5 is a top view of a surface mount resistor according to another embodiment of the present invention.
Figure 6:
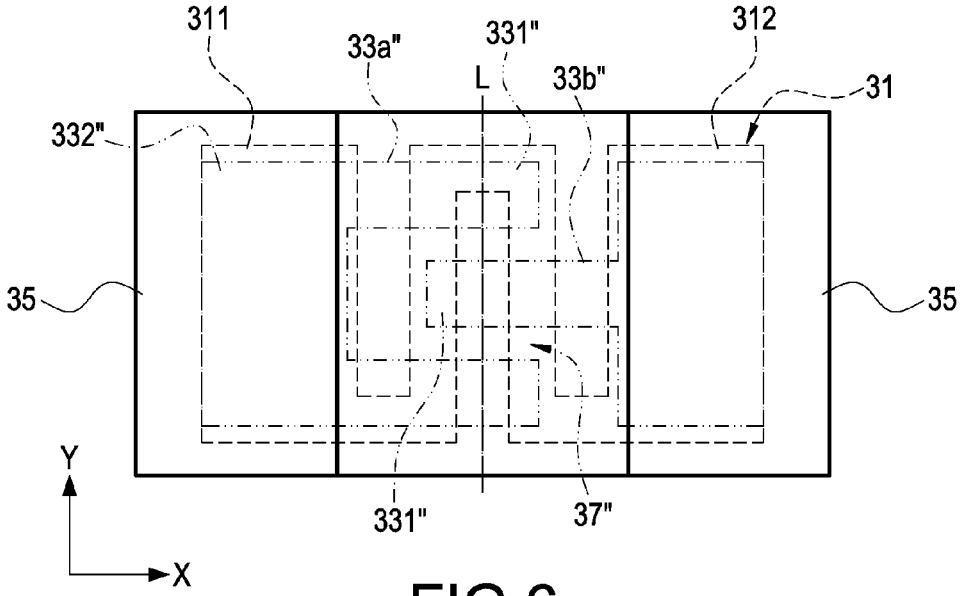
FIG. 6 is a top view of a surface mount resistor according to another embodiment of the present invention.

Referring to FIG. 5 and FIG. 6, the invention further provides several embodiments concerning the practice of the first heat-transfer layer 33*a* and the second heat-transfer layer 33*b*. Mainly, the configuration of the first heat-transfer portion 331 is changed, thus that the first heat-transfer portion 331 covers at least part of the central line L and the width of the first heat-transfer portion 331 is smaller than that of the second heat-transfer portion 332. As shown in FIG. 5, the widths of the first heat-transfer portions 331' of the first heat-transfer layer 33*a*' and the second heat-transfer layer 33*b*' are respectively shrunk from large to small when toward the direction of central line L. For example, the first heat-transfer portion 331' is a triangle covering at least part of the central line L, and a gap 37' having a width d1 is between the first heat-transfer layer 33*a*' and the second heat-transfer layer 33*b*'. The angle between the extension direction of the gap 37' and the width direction of the first heat-transfer portion 331' is formed into an acute angle. As shown in FIG. 6, the first heat-transfer portion 331" of the first heat-transfer layer 33*a*" includes two stripe-shaped portions arranged by interspacing to each other. The first heat-transfer portion 331" of the second heat-transfer layer 33*b*" includes a stripe-shaped portion located between the stripe-shaped portions of the first heat-transfer layer 33*a*". Furthermore, these stripe-shaped portions cover at least part of the central line L, and the extension directions of their lengths are parallel to the first direction X, while the width of the stripe-shaped portion is smaller than that of the second heat-transfer portion 332".

By covering at least part of the central line L by the first heat-transfer portions 331', 331", the area of the heat-transfer layer 33 covering the central portion 313 can be extended into the area of the resistance body having a higher temperature, thus that the heat generated from the resistance body 31 can be effectively transferred to the electrode layers 35 at two sides by the heat-transfer layers 33. Then, the heat is further transferred to the circuit board via the bond pad arranged thereon. Therefore, the temperature of the surface mount resistor 30 is reduced to solve the problem of the prior arts; namely, only heat at two sides of the resistance body can be carried away, while the heat at the central portion having a higher temperature can't be dissipated.

Through the calculation of a simulation software, the central temperatures Tc (as shown in FIG. 1) of the surface mount resistors in FIG. 4, FIG. 5 and FIG. 6 of the present invention are illustrated. In this case, the input power is 0.5 W, the width of the gap is 1000 μm, the thickness of the resistance body is 0.3 mm, and the thickness of the heat-transfer layer is 0.1 mm. Table 1 illustrates the simulation results of the central temperatures of each kind of embodiments, under the same circuit measuring plate.

TABLE 1

| | FIG. 4 | FIG. 5 | FIG. 6 |
|---|---|---|---|
| Configuration of the first heat-transfer portion | rectangle | triangle | stripe |
| Central temperature(° C.) | 102.3 | 99.6 | 91.2 |

As known from Table 1, the change of the configuration of the first heat-transfer portion can effectively lower down the central temperature of the surface mount resistor, wherein the cases having the configurations of triangle and stripe have a well result.

Figure 7:
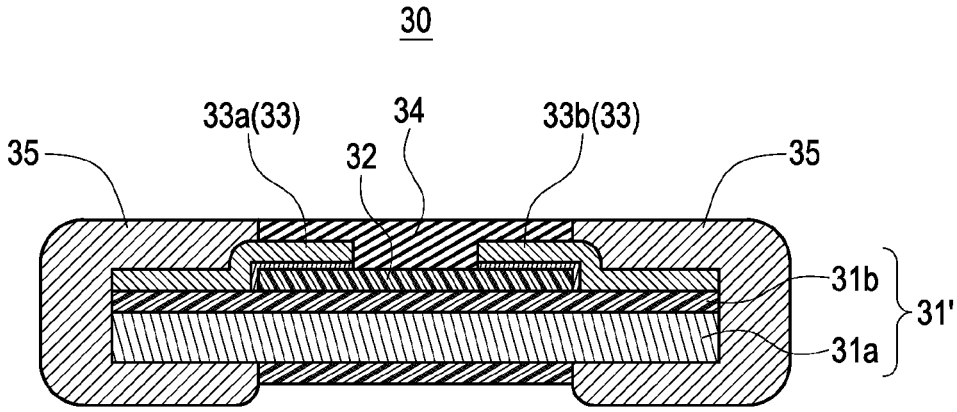
FIG. 7 is a cross-sectional view of a surface mount resistor according to another embodiment of the present invention.
Figure 8:
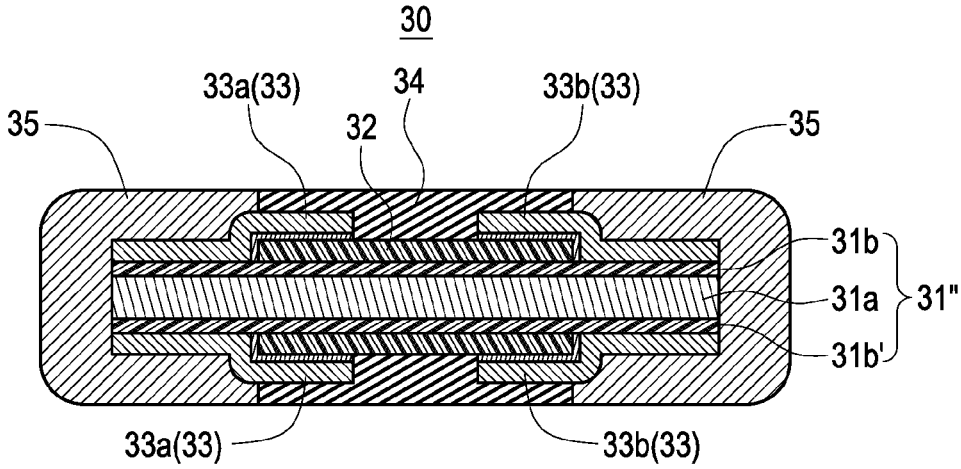
FIG. 8 is a cross-sectional view of a surface mount resistor according to another embodiment of the present invention.

In other embodiments, the resistance body 31 can be further changed as the following. As shown in FIG. 7, the resistance body 31' has an insulating piece 31*a* and at least one metallic layer 31*b* arranged on the upper surface of the insulating piece 31*a*. In this case, the insulating piece 31*a* is made of a material of ceramic, and the metallic layer 31*b* can be arranged on the insulating piece 31 by a pressing process, a printing process or a film-coating process. As shown in FIG. 8, the resistance body 31" has an insulating piece 31*a* and two metallic layers 31*b*, 31*b*' respectively arranged on the upper surface and lower surface of the insulating piece 31*a*. In this case, the heat-transfer layers 33 are arranged on each metallic layers correspondingly.

Figure 9:
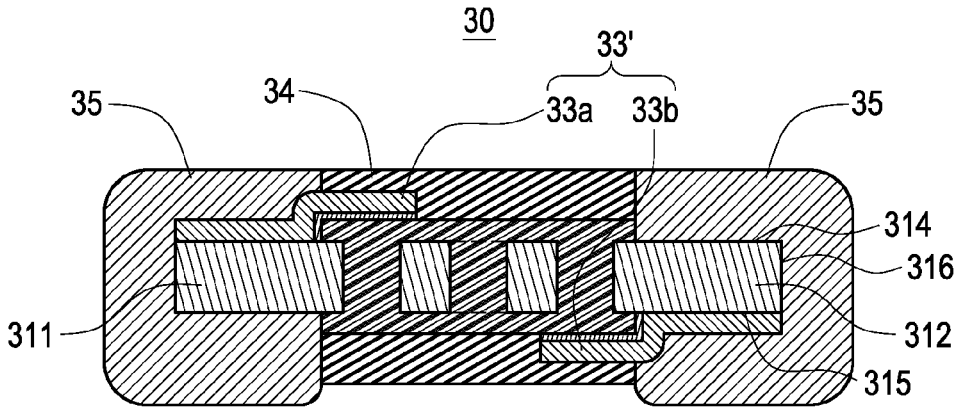
FIG. 9 is a cross-sectional view of a surface mount resistor according to another embodiment of the present invention.
Figure 10:
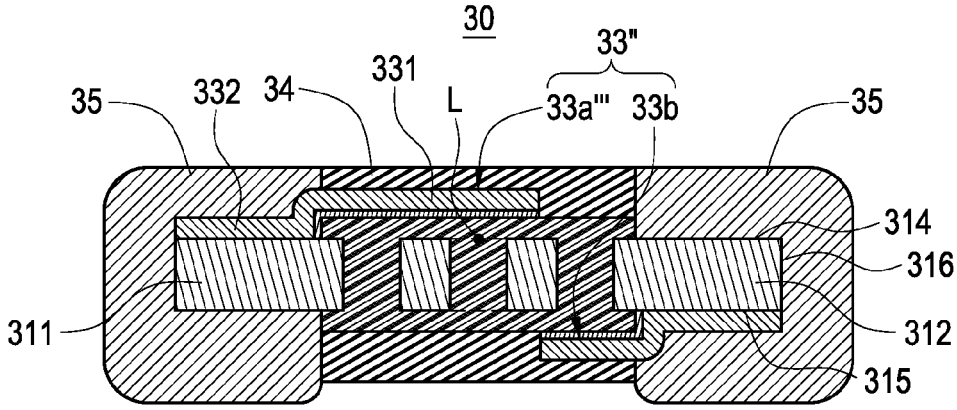
FIG. 10 is a cross-sectional view of a surface mount resistor according to another embodiment of the present invention.

Furthermore, in other embodiments, the heat-transfer layer 33 can be further changed as the following. As shown in FIG. 9, the heat-transfer layer 33' includes a first heat-transfer layer 33*a* arranged on the first surface 314 and a second heat-transfer layer 33*b* arranged on the second surface 315. In this case, the first heat-transfer layer 33*a* and the second heat-transfer layer 33*b* are respectively extended from the first end portion 311 and the second end portion 312 toward the central portion 313 and have different configurations respectively. In addition, according to the heat generation distribution of the resistance body, the first heat-transfer layer and the second heat-transfer layer can adopt different configurations. As shown in FIG. 10, the heat-transfer layer 33" includes a first heat-transfer layer 33*a*' arranged on the first surface 314 and the second heat-transfer layer 33*b* arranged on the second surface 315. In this case, the first heat-transfer layer 33*a*' covers at least part of the central line L and the width of the first heat-transfer portion 331 of the first heat-transfer layer 33*a*' is equal to that of the second heat-transfer portion 332. In addition, the first heat-transfer layer 33*a*' can also adopt the same configuration as shown in FIG. 5 and FIG. 6.

Figure 11:
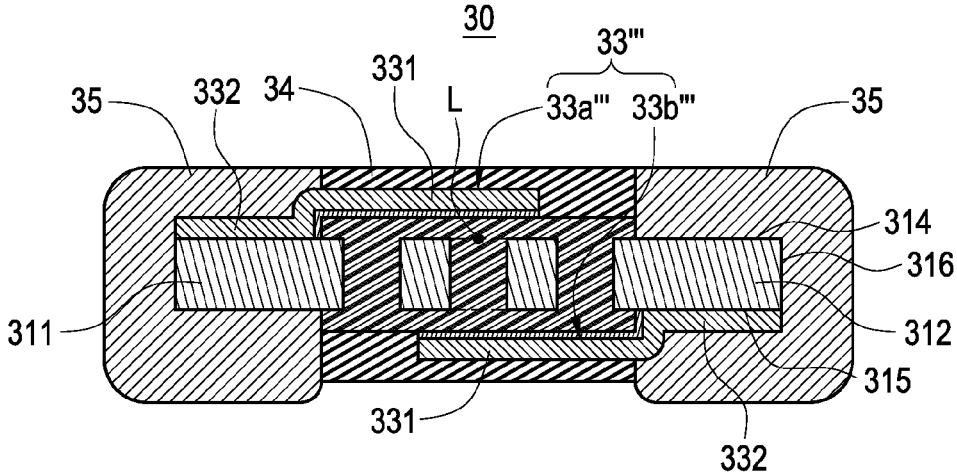
FIG. 11 is a cross-sectional view of a surface mount resistor according to another embodiment of the present invention.

As shown in FIG. 11, the heat-transfer layer 33' includes a first heat-transfer layer 33*a*' arranged on the first surface 314 and the second heat-transfer layer 33*b*' arranged on the second surface 315. In this case, the first heat-transfer layer 33*a*'" and the second heat-transfer layer 33*b*' cover at least parts of the central line L. In the meantime, the width of the first heat-transfer portion 331 of each heat-transfer layers 33*a*', 33*b*' is equal to that of the second heat-transfer portion 332. In addition, the first heat-transfer layer 33*a*''' and the second heat-transfer layer 33*b*' can also adopt the same configuration as shown in FIG. 5 and FIG. 6. The first heat-transfer layers 33*a*', 33*a*'', 33*a*'' and the second heat-transfer layers 33*b*', 33*b*'', 33*b*''' are same as those described thereinbefore, so a repetitious description is not presented herein any further. To deserve to be mentioned, in FIG. 9 through FIG. 11, the projection of the first heat-transfer portion of each heat-transfer layer on the first surface or the second surface can be rectangle, triangle, stripe or other geometric configurations, however, not limited to these configurations only.

The first heat-transfer layers and the second heat-transfer layers of the heat-transfer layers 33', 33'', 33' are respectively disposed on the first surface 314 and the second surface 315 of the resistance body 31, so the area of each heat-transfer layer is increased. The heat dissipation area is augmented, so that the temperature of the surface mount resistor can be effectively decreased, the thermal stability of the resistor is promoted and a more accurate result of measurement can be achieved. Moreover, when the area of each heat-transfer layer is increased, it won't generate the problem of short circuit caused by the contact between the heat-transfer layers.

Accordingly, through the constitution of aforementioned assemblies, a surface mount resistor according to the preferred embodiment of the present invention is thus obtained.

Summarizing aforementioned description, the surface mount resistor proposed by the invention is an indispensably element for the electronic industry, which may positively reach the expected usage objective for solving the drawbacks of the prior arts, and which extremely possesses the innovation and progressiveness to completely fulfill the applying merits of a new type patent, according to which the invention is thereby applied. Please examine the application carefully and grant it as a formal patent for protecting the rights of the inventor.

However, the aforementioned description is only a number of preferable embodiments according to the present invention, not used to limit the patent scope of the invention, so equivalently structural variation made to the contents of the present invention, for example, description and drawings, is all covered by the claims claimed thereinafter.

What is claimed is:

1. A surface mount resistor, comprising:

a resistance body having a first end portion, a second end portion opposite to the first end portion, and a central portion between the first end portion and the second end portion;

a first protective layer disposed on the central portion of the resistance body;

a first heat-transfer layer disposed on the first end portion of the resistance body and a part of the first protection layer, and having a first heat-transfer portion and a second heat-transfer portion connected to the first heat-transfer portion, wherein the first protective layer is arranged between the first heat-transfer portion and the resistance body, and the second heat-transfer portion is connected to the first end portion of the resistance body; and two electrode layers covering the first end portion and the second end portion of the resistance body, and being electrically connected to the first heat-transfer layer, wherein a central line located between the first and the second end portions and passing through a geometric center of the resistance body is defined, and a part of the central line is covered by the first heat-transfer portion of the first heat-transfer layer.

2. The surface mount resistor according to claim 1, wherein the first heat-transfer layer is formed by a deposition process.

3. The surface mount resistor according to claim 1, wherein the first heat-transfer portion and the second heat-transfer portion are formed integrally into an outer metallic layer.

4. The surface mount resistor according to claim 3, wherein the outer metallic layer is formed by plating.

5. The surface mount resistor according to claim 1, wherein a width of the first heat-transfer portion is shrunk from large to small along a direction of the central line.

6. A surface mount resistor, comprising:

a resistance body having a first end portion, a second end portion opposite to the first end portion, and a central portion between the first end portion and the second end portion;

a first protective layer disposed on the central portion of the resistance body;

a first heat-transfer layer disposed on the first end portion of the resistance body and a part of the first protection layer, and having a first heat-transfer portion and a second heat-transfer portion connected to the first heat-transfer portion, wherein the first protective layer is arranged between the first heat-transfer portion and the resistance body, and the second heat-transfer portion is connected to the first end portion of the resistance body; and two electrode layers covering the first end portion and the second end portion of the resistance body, and being electrically connected to the first heat-transfer layer, wherein the first heat-transfer portion has a plurality of stripe-shaped portions arranged by interspacing to each other, and a width of each stripe-shaped portions is smaller than a width of the second heat-transfer portion.

7. The surface mount resistor according to claim 1, further comprising a second heat-transfer layer disposed on the second end portion of the resistance body and a part of the first protective layer, and separated from the first heat-transfer layer.

8. The surface mount resistor according to claim 7, wherein the first heat-transfer layer and the second heat-transfer layer are substantially symmetrically on the central portion of the resistance body.

9. The surface mount resistor according to claim 1, further comprising a second heat-transfer layer, the resistance body having a first surface and a second surface corresponding to the first surface, and the first heat-transfer layer and the second heat-transfer layer being disposed on the first surface, a gap existing between the first heat-transfer layer and the second heat-transfer layer.

10. A surface mount resistor, comprising:

a resistance body having a first end portion, a second end portion opposite to the first end portion, and a central portion between the first end portion and the second end portion;

a first protective layer disposed on the central portion of the resistance body;

a first heat-transfer layer disposed on the first end portion of the resistance body and a part of the first protection layer, and having a first heat-transfer portion and a second heat-transfer portion connected to the first heat-transfer portion, wherein the first protective layer is arranged between the first heat-transfer portion and the resistance body, and the second heat-transfer portion is connected to the first end portion of the resistance body;

two electrode layers covering the first end portion and the second end portion of the resistance body, and being electrically connected to the first heat-transfer layer; and a second heat-transfer layer, the resistance body having a first surface and a second surface corresponding to the first surface, the first heat-transfer layer and the second heat-transfer layer being respectively disposed on the first surface and the second surface.

11. The surface mount resistor according to claim 10, wherein the first heat-transfer layer and the second heat-transfer layer have an overlapping portion.

12. The surface mount resistor according to claim 1, wherein the first protective layer is made of an insulating material.

13. The surface mount resistor according to claim 1, wherein a thickness of the first protective layer is 50 to 150 μm.

14. The surface mount resistor according to claim 1, wherein the first protective layer is made of an insulating solid material and has a heat transfer coefficient of 0.2 to 0.5 W/(m K).

15. The surface mount resistor according to claim 1, further comprising a second protective layer disposed on the first heat-transfer layer and covering the central portion of the resistance body.

16. The surface mount resistor according to claim 15, wherein the second protective layer is made of phenol-formaldehyde resin.

17. The surface mount resistor according to claim 15, wherein the second protective layer is made of an insulating material having a far infrared powder.

18. The surface mount resistor according to claim 17, wherein the insulating material comprises the far infrared powder over 90% and is manufactured from a molding process.

19. The surface mount resistor according to claim 1, wherein the first heat-transfer layer further includes an inner metallic layer disposed on the first protective layer and located between the first heat-transfer portion and the first protective layer.

* * * * *